US006567989B1

(12) United States Patent
Martinez

(10) Patent No.: US 6,567,989 B1
(45) Date of Patent: May 27, 2003

(54) PROTECTIVE GARMENT

(76) Inventor: Alberto Martinez, 4919 Murphy Pl., West New York, NJ (US) 07093

( * ) Notice: Subject to any disclaimer, the term of this patent is extended or adjusted under 35 U.S.C. 154(b) by 0 days.

(21) Appl. No.: 10/074,380

(22) Filed: Feb. 12, 2002

(51) Int. Cl.[7] ..... A41D 1/06
(52) U.S. Cl. ..... 2/69; 2/227; 2/211; 2/79
(58) Field of Search ..... 2/69, 69.5, 46, 2/47, 48, 51, 70–72, 74, 75, 79, 80, 83, 93, 94, 211, 212, 213, 214, 227, 232, 242, 243.1, 114, 22, 23

(56) References Cited

U.S. PATENT DOCUMENTS

| | | | | | |
|---|---|---|---|---|---|
| 717,854 | A | | 1/1903 | Holston | |
| 849,268 | A | | 4/1907 | Rutenbeck | |
| 945,345 | A | | 1/1910 | Richards | |
| 1,690,138 | A | | 11/1928 | Sladek | |
| 1,783,572 | A | * | 12/1930 | Johnson | 2/69 |
| 2,727,240 | A | | 12/1955 | Marshall | |
| 2,744,252 | A | | 5/1956 | Cansler | |
| D208,527 | S | | 9/1967 | Grengg | |
| 3,514,788 | A | | 6/1970 | Miller | |
| 3,517,394 | A | | 6/1970 | Robinson | |
| D249,906 | S | | 10/1978 | Kohutis et al. | |
| 4,390,996 | A | * | 7/1983 | Read | 2/70 |
| 4,718,122 | A | * | 1/1988 | Steverson | 2/70 |
| 5,331,685 | A | * | 7/1994 | Belgard | |

FOREIGN PATENT DOCUMENTS

| | | | | |
|---|---|---|---|---|
| DE | 3339221 | * | 5/1984 | 2/79 |

* cited by examiner

*Primary Examiner*—Gloria M. Hale
(74) *Attorney, Agent, or Firm*—Richard M. Goldberg

(57) ABSTRACT

A protective garment includes a torso portion for covering a person's torso; a lower portion for covering a person's legs and including left and right leg portions, each having an inner edge and an outer edge; a first fastening arrangement at the inner edge of each leg portion for securing the inner edges together to form an apron-like arrangement of the lower portion; a second fastening arrangement at the inner and outer edges of the left leg portion for securing the same around a left leg of the person; a third fastening arrangement at the inner and outer edges of the right leg portion for securing the same around a right leg of the person; and a fourth fastening arrangement at a waist area for connecting and disconnecting the torso portion and the lower portion relative to each other.

6 Claims, 1 Drawing Sheet

PROTECTIVE GARMENT

BACKGROUND OF THE INVENTION

The present invention relates generally to a protective garment for clothing, and more particularly, is directed to a protective garment to be worn over clothing to prevent stains and/or entanglement of the person's clothing.

While performing certain activities, there is often a problem of staining or damaging the clothes of a wearer. This can take various forms, for example, grease and oil on a person's clothes while working on automotive vehicles, paint while painting, entanglement of clothing in machinery, etc.

Various solutions have been proposed for this problem. In one solution, the person removes his or her own clothing and dons special work clothing. This, however, may not be practical in all circumstances. Another solution is to wear protective clothing over the person's clothing. This can take the form of an apron, overalls, etc.

However, a problem with conventional protective clothing is that it is not very versatile. For example, aprons which hang down in front of a person are known and protective garments which wrap around the legs of a person are known, but this requires two separate garments. In the case of protective garments which wrap around the legs, such as in U.S. Pat. No. 945,345 to Richards, the leg portions in the non-used state hang down in an apron fashion. However, in this state, there is no arrangement for securing the leg portions together to form a continuous apron-like state in use. Rather, the leg portions remain separated and can flap about and be easily caught in machinery. Thus, Richards only envisions use in the state where the leg portions are wrapped around the individual legs of the person. See also U.S. Pat. No. 717,854 to Holston; U.S. Pat. No. 849,268 to Rutenbeck and U.S. Pat. No. 3,517,394 to Robinson for similar problems.

In addition, it is desirable at different times to provide a protective garment only for the torso such as found in U.S. Pat. No. 2,727,240 to Marshall and U.S. Pat. No. 3,514,788 to Miller, a protective garment only for the legs such as found in U.S. Pat. No. 3,517,394 to Robinson, or a protective garment for both the torso and the legs. This would normally require three different protective garments, making this cost prohibitive. Most protective garments are therefore provided for both the torso and the legs. See, for example, U.S. Pat. No. 717,854 to Holston; U.S. Pat. No. 849,268 to Rutenbeck; U.S. Pat. No. 945,345 to Richards; U.S. Pat. No. 1,690,138 to Sladek; U.S. Pat. No. 2,744,252 to Cansler; and U.S. Design Pat. No. 208,527 to Grengg.

OBJECTS AND SUMMARY OF THE INVENTION

Accordingly, it is an object of the present invention to provide a protective garment that overcomes the problems with the aforementioned prior art.

It is another object of the present invention to provide a protective garment that is sufficiently versatile to be used to cover only the torso, only the legs, or both the torso and legs.

It is still another object of the present invention to provide a protective garment having leg portions that can selectively be wrapped and secured about the individual legs or secured together in front of the person in an apron-like manner.

In accordance with an aspect of the present invention, a protective garment includes a torso portion adapted to cover a torso of a person; a lower portion adapted to cover legs of a person, the lower portion including left and right leg portions, each of the left and right leg portions including an inner edge and an outer edge; a first fastening arrangement at the inner edges of, the left and right leg portions for securing the inner edges together to form an apron-like arrangement of the lower portion; a second fastening arrangement at the inner and outer edges of the left leg portion for securing the left leg portion around a left leg of the person; and a third fastening arrangement at the inner and outer edges of the right leg portion for securing the right leg portion around a right leg of the person.

The fastening arrangements can be any of the following: zippers, loops and buttons, hook and loop fastening arrangements (VELCRO®), snaps, clasps, brooches and hooks.

The lower portion further includes an abdominal portion connected with upper ends of the leg portions, and substantially horizontal slits extending outwardly from upper ends of the inner edges of the leg portions to enable the leg portions to be wrapped about a person's legs.

Preferably, the first fastening arrangement forms part of the second and third fastening arrangements.

In addition, the torso portion includes a slit extending down from a neckline thereof, and a further fastening arrangement for selectively opening and closing the slit.

In accordance with another aspect of the present invention, a protective garment includes a torso portion adapted to cover a torso of a person; a lower portion adapted to cover legs of a person; and a fastening arrangement at a waist area of the protective garment for connecting and disconnecting the torso portion and the lower portion relative to each other.

In accordance with another aspect of the present invention, a protective garment includes a torso portion adapted to cover a torso of a person; a lower portion adapted to cover legs of a person, the lower portion including a left and right leg portions, each of the left and right leg portions including an inner edge and an outer edge; a first fastening arrangement at the inner edges of the left and right leg portions for securing the inner edges together to form an apron-like arrangement of the lower portion; a second fastening arrangement at the inner and outer edges of the left leg portion for securing the left leg portion around a left leg of the person; a third fastening arrangement at the inner and outer edges of the right leg portion for securing the right leg portion around a right leg of the person; and a fourth fastening arrangement at a waist area of the protective garment for connecting and disconnecting the torso portion and the lower portion relative to each other.

The above and other objects, features and advantages of the invention will become readily apparent from the following detailed description thereof which is to be read in connection with the accompanying drawings.

DETAILED DESCRIPTION

Figure 1:
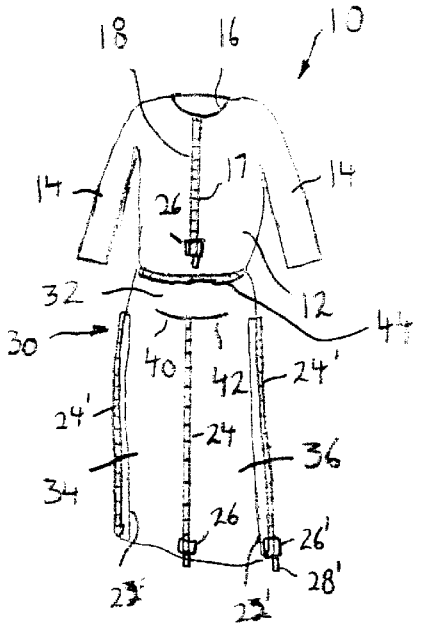
FIG. 1 is a front elevational view of a protective garment according to a first embodiment of the present invention in an apron-like state.

Referring to the drawings in detail, and initially to FIG. 1, there is shown a protective garment 10 according to a first embodiment of the present invention which is intended to be worn over the clothes of a person to protect the person's clothing. However, the present invention is not limited thereby and protective garment 10 can be worn by itself as the main clothing of the person, rather than being worn over a person's existing clothing.

Protective garment 10 includes a torso portion 12 intended to be worn over the torso of a person and including sleeves 14 on opposite sides for covering a person's arms. Torso portion 12 includes an open neck section 16 so that protective garment can be slipped over the head of the person. In this regard, a lengthwise slit 17 is provided in torso portion 12, extending from the neckline to a position above the waist, and a fastening arrangement 18 is provided by which slit 17 can be opened to more easily enable protective garment 10 to slip over the head of the person, whereupon slit 17 is thereafter closed by fastening arrangement 18. Fastening arrangement 18 can take any suitable form, for example, a zipper arrangement as shown in FIG. 4, a button arrangement as shown in FIG. 5, etc.

Figure 4:
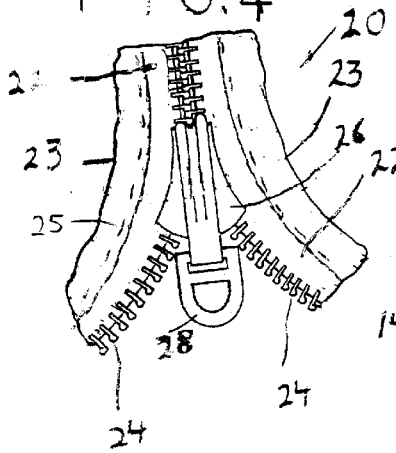
FIG. 4 is a plan view of a zipper that can be used with the protective garments of FIGS. 1–3.
Figure 5:
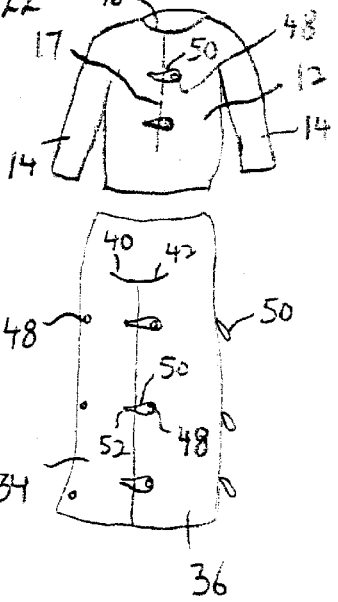
FIG. 5 is a front elevational view of a protective garment according to a third embodiment of the present invention, showing the torso portion separated from the lower portion.

As shown in FIG. 4, zipper arrangement 20 includes stringers 22 secured to opposite sides of the fabric 23 of torso portion 12 at the opening therefor by any suitable means such as stitching 25 or the like, each stringer 22 having interlocking links or teeth 24 therealong. A slider 26 is non-removably and slidably positioned on teeth 24 of one stringer 22 for movement therealong, and is adapted to engage with teeth 24 of the other stringer 22 in order to interlock the teeth 24 of both stringers 22 together, as is conventional. In this regard, a pull tab 28 is provided on slider 26 for pulling slider 26 along teeth 24.

Protective garment 10 further includes a lower portion 30 having a continuous abdominal section 32 that leads into lower right and left leg portions 34 and 36 having inner edges defined by fabric portions 23 shown in FIG. 4. The zipper arrangement 20 of FIG. 4 is also provided thereat to connect together leg portions 34 and 36 in the apron-like arrangement shown in FIG. 1. In this regard, slider 26 is provided on teeth 24 of stringer 23 associated with leg portion 34 when zipper arrangement 20 disconnects leg portions 34 and 36.

Figure 3:
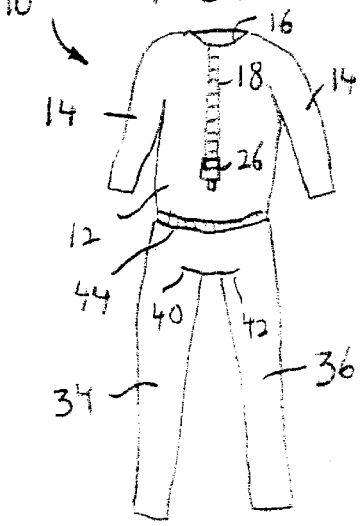
FIG. 3 is a cross-sectional view of the protective garment of FIG. 2, showing the leg portions wrapped around the individual legs.

In accordance with one aspect of the present invention, a stringer 22' having teeth 24' is secured to the opposite free sides of each leg portion 34 and 36, and a slider 26' having a pull tab 28' is provided on teeth 24' of stringer 22' associated with leg portion 36. In this regard, when the opposite ends of leg portion 34 are wrapped about the person's right leg, slider 26 can secure together teeth 24 and 24' of leg portion 34. In like manner, when the opposite ends of leg portion 36 are wrapped about the person's right leg, slider 26' can secure together teeth 24 and 24' of leg portion 36. This arrangement is shown in FIG. 3. In this regard, the zipper arrangements can be used for securing inner edges of leg portions 34 and 36 together in an apron-like manner or opposite edges of the same leg portion 34 or 36 together around the person's individual legs.

In order to better enable leg portions 34 and 36 to be wrapped around the person's legs, a right horizontal slit 40 is provided at the upper edge of leg portion 34 and meets with the upper edge of the stringer 22 thereat, and a left horizontal slit 42 is provided at the upper edge of leg portion 36 and meets with the upper edge of the stringer 22 thereat.

Figure 2:
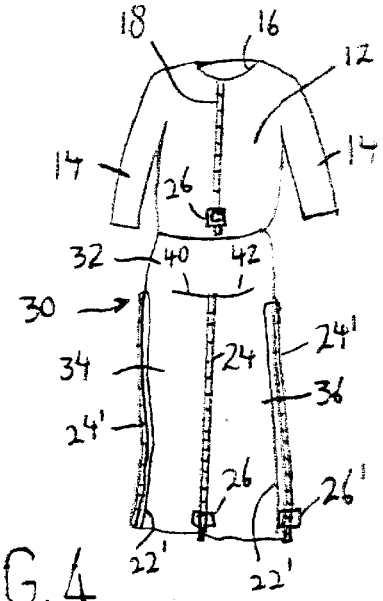
FIG. 2 is a front elevational view of a protective garment according to a second embodiment of the present invention in an apron-like state.

In accordance with another aspect of the present invention, torso portion 12 can be separated from lower portion 30. Specifically, a removable securing arrangement 44 is provided at the waist connection therebetween. For example, removable securing arrangement 44 can be the zipper arrangement of FIG. 4. Alternatively, torso portion 12 can be fixedly secured with lower portion 30, such that removable securing arrangement 44 is eliminated, as shown in FIG. 2.

It will be appreciated that any suitable securing arrangement can be used in place of zipper arrangement 20. For example, buttons 48 and loops 50 can be provided in place thereof. Such an embodiment is shown in FIG. 5 in which the inner edge of leg portion 34 is provided with loops 50, for example, elastic loops, secured by rivets 52 or the like and buttons 48 are provided at the same height along the inner edge of leg portion 36. Thus, when loops 50 are stretched over buttons 48, leg portions 34 and 36 are provided in the apron-like arrangement.

Further buttons 48 are provided at the same height along the outer edge of leg portion 34 and loops 50 are provided at the outer edge of leg portion 36. Thus, when leg portions 34 and 36 are wrapped around the person's legs, loops 50 on leg portion 34 are stretched around buttons 48 of leg portion 34, and loops 50 on leg portion 36 are stretched around buttons 48 of leg portion 36.

A similar loop 50 and button 48 arrangement is provided on torso portion 12 as the fastening arrangement 18.

It will be appreciated that various modifications can be made to the present invention, within the scope of the claims. Thus, any other suitable fastening arrangement, other than a zipper arrangement, and loops and buttons, can be used. For example, the hook and loop fastening arrangement sold under the trademark VELCRO can be used, as well as snaps, clasps, brooches, hooks, etc.

Protective garment 10 according to the present invention can be used in many different environments. For example, beauticians or hair stylists can use protective garment 10 to prevent colorants and tints from sprinkling on their clothes. Other professions that can used protective garment 10 can be doctors, dentists, nurses, painters, automotive mechanics, food service personnel, farmers, landscapers, gardeners.

Further, protective garment 10 can be made of a durable material for repeated use, or a less durable material that would render protective garment disposable. For example, protective garment 10 can be made from plastic, textiles such as cloth, nylon, etc., paper, etc.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. A protective garment comprising:

a torso portion adapted to cover a torso of a person;

a lower portion adapted to cover legs of a person, the lower portion including:

left and right leg portions, each of said left and right leg portions including an inner edge and an outer edge, an abdominal portion connected with upper ends of said leg portions, and substantially horizontal slits extending outwardly from upper ends of the inner edges of said leg portions to enable said leg portions to be wrapped about a person's legs;

a first fastening arrangement at the inner edges of said left and right leg portions for securing said inner edges together to form an apron-like arrangement of said lower portion;

a second fastening arrangement at the inner and outer edges of said left leg portion for securing said left leg portion around a left leg of the person; and a third fastening arrangement at the inner and outer edges of said right leg portion for securing said right leg portion around a right leg of the person.

2. A protective garment according to claim 1, wherein said first, second and third fastening arrangements are selected from the group consisting of zippers, loops and buttons, hook and loop fastening arrangements, snaps, clasps, brooches and hooks.

3. A protective garment according to claim 1, wherein said first fastening arrangement forms part of said second and third fastening arrangements.

4. A protective garment according to claim 1, wherein said torso portion includes a slit extending down from a neckline thereof, and a further fastening arrangement for selectively opening and closing said slit.

5. A protective garment according to claim 1, further comprising:

a fourth fastening arrangement at a waist area of said protective garment for connecting and disconnecting said torso portion and said lower portion relative to each other.

6. A protective garment according to claim 5, wherein said fourth fastening arrangement is selected from the group consisting of zippers, loops and buttons, hook and loop fastening arrangements, snaps, clasps, brooches and hooks.

* * * * *